US006231692B1

(12) United States Patent
Vogt et al.

(10) Patent No.: US 6,231,692 B1
(45) Date of Patent: May 15, 2001

(54) NICKEL BASE SUPERALLOY WITH IMPROVED MACHINABILITY AND METHOD OF MAKING THEREOF

(75) Inventors: Russell G. Vogt; John Corrigan, both of Yorktown, VA (US); John R. Mihalisin, N. Caldwell, NJ (US); Ursula Pickert, Ruhr; Winfried Esser, Bochum, both of (DE)

(73) Assignees: Howmet Research Corporation, Whitehall, MI (US); Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/239,358

(22) Filed: Jan. 28, 1999

(51) Int. Cl.[7] ..... C22C 19/05; C22F 1/10

(52) U.S. Cl. ..... 148/428; 148/675; 148/555; 420/446; 420/449; 420/450

(58) Field of Search ..... 420/446, 449, 420/450, 428, 675, 555

(56) References Cited

U.S. PATENT DOCUMENTS

| | | | | |
|---|---|---|---|---|
| Re. 28,681 | | 1/1976 | Baldwin | 75/134 F |
| 3,202,552 | | 8/1965 | Thexton | 148/13 |
| 3,283,377 | | 11/1966 | Chandley | 22/212 |
| 3,494,709 | | 2/1970 | Piearcey | 416/232 |
| 3,615,376 | | 10/1971 | Ross | 75/171 |
| 3,681,061 | | 8/1972 | Fletcher | 75/171 |
| 3,850,624 | | 11/1974 | Hulit et al. | 75/171 |
| 4,127,410 | | 11/1978 | Merrick et al. | 75/171 |
| 4,140,555 | | 2/1979 | Garcia et al. | 148/32 |
| 4,569,824 | | 2/1986 | Duhl et al. | 420/448 |
| 4,814,023 | | 3/1989 | Chang | 148/2 |
| 4,844,864 | | 7/1989 | Frank | 420/447 |
| 4,867,812 | | 9/1989 | Henry | 148/428 |
| 4,961,818 | | 10/1990 | Benn | 156/603 |
| 5,294,239 | | 3/1994 | Zoltzer et al. | 75/237 |
| 5,582,635 | | 12/1996 | Czech et al. | 106/14.05 |
| 5,815,792 | * | 9/1998 | Duquenne et al. | 420/449 |

* cited by examiner

*Primary Examiner*—Deborah Yee

(57) ABSTRACT

Machineable nickel base alloy casting, consisting essentially of, in weight %, about 12.5% to 15% Cr, about 9.00% to 10.00% Co, about 3.70% to 4.30% Mo, about 3.70% to 4.30% W, about 2.80% to 3.20% Al, about 4.80% to 5.20% Ti, about 0.005% to 0.02% B, up to about 0.10% Zr, and balance essentially Ni and carbon below about 0.08 weight % to improve machinability while retaining alloy strength properties after appropriate heat treatment.

16 Claims, 1 Drawing Sheet

NICKEL BASE SUPERALLOY WITH IMPROVED MACHINABILITY AND METHOD OF MAKING THEREOF

FIELD OF THE INVENTION

The present invention relates to nickel base superalloys and castings made therefrom and, more particularly, to a nickel base superalloy and casting having improved machinability while retaining beneficial alloy mechanical properties.

BACKGROUND OF THE INVENTION

U.S. Pat. No. 3,615,376 describes a nickel base superalloy having a composition consisting essentially of, in weight %, 0.1 to 0.3% C, greater than 13% to less than 15.6% Cr, greater than 5% to less than 15% Co, 2.5% to 5% Mo, 3% to 6% W, 2% to 4% Al, 4% to 6% Ti, 0.005% to 0.02% B, up to 0.1% Zr, and balance essentially nickel with the ratio of Ti to Al being greater than 1 but less than 3; the sum of Ti and Al being 7.5%–9 weight %; and the sum of Mo and half of the W being 5 to 7 weight %. Carbon concentrations of 0.08 weight % and below are said to be insufficient to achieve high temperature alloy strength properties.

This nickel base superalloy exhibits improved high temperature stability, strength, and corrosion resistance. However, large gas turbine engine blades and vanes of industrial gas turbine (IGT) engines conventionally cast (e.g. equiaxed casting microstructure) from this superalloy exhibit inadequate machinability as a result of the cast microstructure containing large equiaxed grains, chemical segregation in thicker sections of the IGT castings, and undesirable carbide formation at the grain boundaries that embrittles the grain boundaries and can result in cracking or carbide/grain pull out during subsequent machining of the casting by such machining processes as grinding.

As a result, current machining practice for such IGT castings involves greatly increasing machining times by reducing machining feed rates to reduce cracking and carbide/grain pullout and produce a satisfactory machined surface finish. For example, the machining time of a large IGT equiaxed cast gas turbine engine blade cast from the above superalloy typically consumes 270 minutes.

An object of the present invention is to modify the above nickel base superalloy to unexpectedly and substantially improve its machinability, especially machinability of large equiaxed IGT castings produced from the modified superalloy, without adversely affecting the desirable alloy high temperature mechanical properties.

SUMMARY OF THE INVENTION

The present invention involves modifying the carbon content of the nickel base superalloy described hereabove in a manner discovered to unexpectedly and significantly improve its machinability, especially when conventionally cast and heat treated to produce large cross-section, equiaxed grain castings, such as IGT blades and vanes. In accordance with the present invention, the carbon content of the aforementioned superalloy composition is reduced to an amount effective to substantially improve machinability without adversely affecting the desirable alloy high temperature mechanical properties. The carbon concentration is controlled below about 0.08 weight %, preferably from about 0.055% to about 0.075% by weight of the superalloy composition to this end.

A preferred nickel base superalloy in accordance with an embodiment of the present invention consists essentially of, in weight %, of about 12.5% to 15% Cr, about 9.00% to 10.00% Co, about 3.70% to 4.30% Mo, about 3.70% to 4.30% W, about 2.80% to 3.20% Al, about 4.80% to 5.20% Ti, about 0.005% to 0.02% B, up to about 0.10% Zr, about 0.055% to 0.075% C and balance essentially Ni. The modified nickel base superalloy can be cast as equiaxed grain castings pursuant to conventional casting techniques to produce large castings, such as IGT blades and vanes, that exhibit a surprising and significant improvement in machinability (e.g. 33% reduction in machining time) after appropriate heat treatment as compared to the same superalloy casting similarly heat treated with higher carbon content.

The above objects and advantages of the present invention will become more readily apparent from the following detailed description taken with the following drawings.

DETAILED DESCRIPTION OF THE INVENTION

Figure 1:
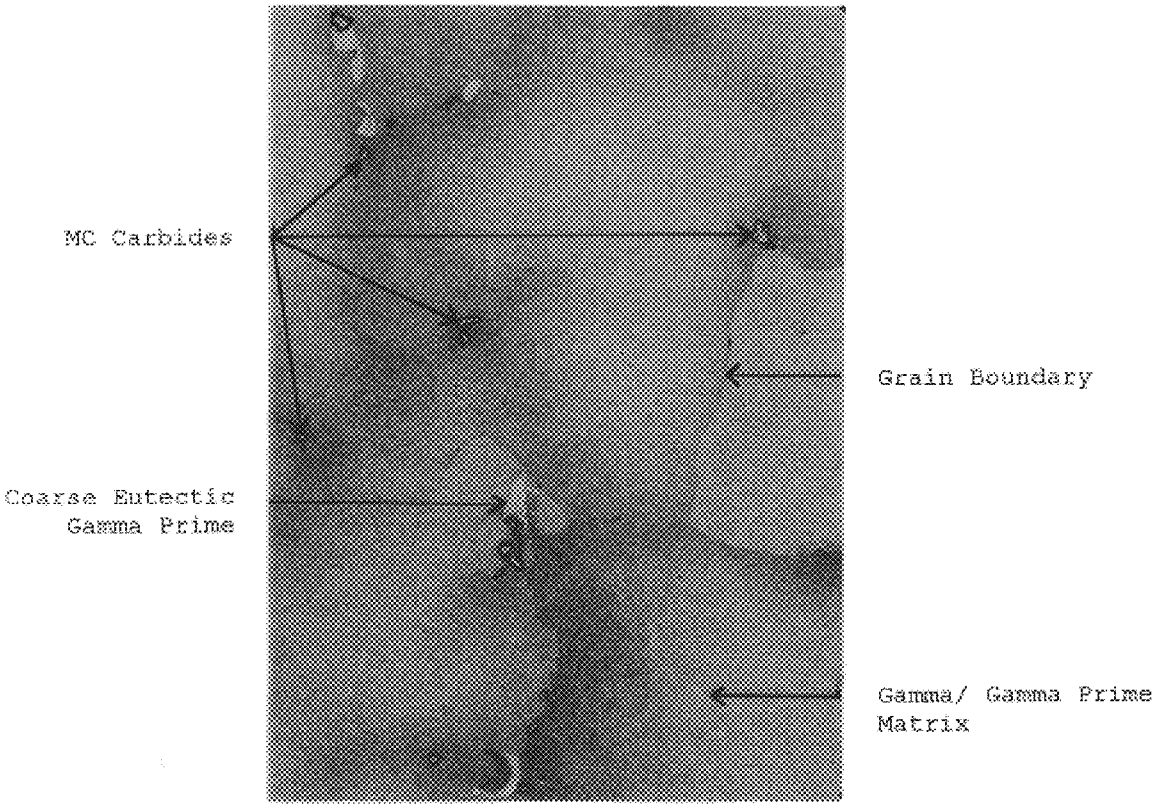
FIG. 1 is a photomicrograph at 100× of the carbon modified superalloy pursuant to the invention showing the equiaxed as-cast microstructure.

The present invention involves modifying the carbon concentration of a particular nickel base superalloy in a manner discovered to unexpectedly and surprisingly provide significantly enhanced machinability especially when conventionally cast to produce large cross-section, equiaxed grain castings, such as IGT blades and vanes. Moreover, the significant improvement in machinability is achieved without adversely affecting the desirable alloy high temperature mechanical properties. The nickel base superalloy which is modified pursuant to the present invention is described in U.S. Pat. No. 3,615,376, the teachings of which are incorporated herein by reference. A nickel base superalloy in accordance with an embodiment of the invention consists essentially of, in weight %, 12.5 to about 15% Cr, greater than 5% to less than 15% Co, 2.5% to 5% Mo, 3% to 6% W, 2% to 4% Al, 4% to 6% Ti, 0.005% to 0.02% B, up to 0.1% Zr, and balance essentially nickel and carbon with the ratio of Ti to Al being greater than 1 but less than 3; the sum of Ti and Al being 7.5–9 weight %; the sum of Mo and half of the W being 5–7 weight %; and with carbon content maintained below 0.08% to unexpectedly improve machinability after appropriate heat treatment such as solution heat treatment and precipitation hardening heat treatment steps by virtue of beneficially affecting primary carbides in the alloy microstructure, while providing acceptable mechanical properties. The Cr concentration preferably is reduced in the range of about 13 to about 14 weight %, preferably nominally 13.5 weight % Cr, to compensate for the lower carbon content of the alloy of the invention.

A nickel base superalloy in accordance with an embodiment of the invention consists essentially of, in weight %, of about 12.5% to 15% Cr, about 9.00% to 10.00% Co, about 3.70% to 4.30% Mo, about 3.70% to 4.30% W, about 2.80% to 3.20% Al, about 4.80% to 5.20% Ti, about 0.005% to 0.02% B, up to about 0.10% Zr, less than about 0.08% C, and balance essentially Ni.

The present invention modifies the aforementioned nickel base superalloy to reduce the carbon content below about 0.08 weight % in an amount discovered effective to improve its machinability while retaining alloy strength properties. Preferably, the nickel base superalloy is modified by reducing carbon in the range of about 0.055% to about 0.075% by weight, preferably about 0.07% by weight, of the superalloy composition to this end.

A particularly preferred carbon modified nickel base superalloy casting composition in accordance with the present invention consists essentially of, in weight %, nominally about 13.50% Cr, about 9.40% Co, about 4.0% Mo, about 4.00% W, about 3.00% Al, about 5.00% Ti, about 0.015% B, about 0.07% C, and balance essentially Ni and castable by conventional techniques, such as vacuum investment casting to produce equiaxed grain, as-cast microstructure, FIG. 1. The as-cast equiaxed microstructure of the casting typically comprises a gamma/gamma prime matrix with primary MC carbides in grain boundaries and interdendritic regions. There also is evidence of coarse eutectic gamma prime in the microstructure.

The following casting tests were conducted and are offered to illustrate, but not limit, the present invention. A heat #1 having a nickel base superalloy composition in accordance with the aforementioned U.S. Pat. No. 4,597,809 and a heat #2 of carbon modified nickel base superalloy in accordance with the present invention were prepared with the following compositions, in weight percentages, set forth in Table I:

TABLE I

| Heat | Cr | Co | Mo | W | Ta | Al | Ti | C | B | Ni |
|---|---|---|---|---|---|---|---|---|---|---|
| #1 | 14.0 | 9.4 | 4.0 | 4.0 | — | 3.0 | 5.0 | 0.16 | 0.015 | bal |
| #2 | 13.54 | 9.42 | 3.99 | 3.99 | — | 3.06 | 5.02 | 0.058 | 0.015 | bal |

bal = balance

The carbon content of heat #2 was controlled to be lower than that of heat #1 (e.g. aim C of 0.06 weight % for heat #2) and was provided by first forming a charge using NiCo alloy, Cr, and other elemental charge constituents with addition of pure carbon in an amount to effect a carbon boil to reduce carbon and oxygen in the melt. Then, the final carbon concentration was achieved by addition of pure carbon to the melt after the carbon boil to achieve the aim carbon value. Heats #1 and #2 both were produced using commercial vacuum-melting techniques widely used in the preparation of nickel base superalloys.

Both heats were remelted in a crucible of a conventional casting furnace under a vacuum of less than 1 micron and superheated to 1482 degrees C. (2700 degrees F.). The superheated melt was poured under vacuum into an investment casting mold having a facecoat comprising one layer of fine ceramic oxide (e.g. $Al_2O_3$, $SiO_2$, $ZrO_2$ and the like) backed by additional slurry/stucco layers comprising 9 to 15 layers of coarse ceramic oxide particles (stucco). The mold was preheated to 1093 degrees C. (2000 degrees F.). The melt in the mold was solidified to room temperature in air. After the equiaxed castings were cooled to room temperature, they were removed from the mold in conventional manner using a mechanical knock-out procedure. The castings then were solution heat treated at 1204 degrees C. (2200 degrees F.) for 2 hours followed by aging (precipitation hardening) at 1095 degrees C. (2002 degrees F.) for 4 hours plus 1080 degrees C. (1970 degrees F.) for 4 hours plus 870 degrees C. (1600 degrees F.) for 12 hours. The heat treated castings then were analyzed for chemistry and machined to appropriate specimen configurations. Tensile testing was conducted in air at a temperature of 870 degrees C. (1598 degrees F.). Stress rupture testing was conducted in air at 980 degrees C. (1796 degrees F.) and stress of 190 MPa (27.6 Ksi). Machinability testing was conducted at a production gas turbine blade machining facility as described below.

The results of tensile testing and stress rupture testing are set forth in TABLES II and III below where LIFE in hours (HRS) indicates the time to fracture of the specimen, ELONGATION is the specimen elongation to fracture, and RED OF AREA is the reduction of area of the specimens to fracture. The BASELINE data corresponds to test data for Heat #1, and the INVENTION data corresponds to test data for heat #2 pursuant to the invention. The BASELINE data represent an average of two tensile and two stress rupture test specimens, while the INVENTION data represent an average of 6 tensile and stress rupture test specimens.

TABLE II

| ALLOY | # OF TESTS | TEMPERATURE-C (F) | UTS Mps (KSI) | 0.2% YS Mps (KSI) | ELONGATION (%) | RED OF AREA (%) |
|---|---|---|---|---|---|---|
| BASELINE | 2 | 870 (1598) | 775.7 (112.5) | 549.9 (79.8) | 18.0 | 23.0 |
| INVENTION | 6 | 870 (1598) | 772.9 (112.1) | 542.4 (78.7) | 17.1 | 20.4 |

TABLE III

| ALLOY | # OF TESTS | TEMPERATURE-C (F) | STRESS-Mpa (KSI) | LIFE (HRS) | ELONGATION (%) | RED OF AREA (%) |
|---|---|---|---|---|---|---|
| BASELINE | 2 | 980 (1796) | 190 (27.6) | 34.7 | 11.6 | 15.9 |
| INVENTION | 6 | 980 (1796) | 190 (27.6) | 40.2 | 6.6 | 8.1 |

It is apparent from TABLES II and III that the specimens produced from heat #1 and from heat #2 pursuant to the invention exhibited generally comparable tensile and stress rupture properties. The alloy of the invention at a carbon level of less than 0.08 weight % unexpectedly and surprisingly exhibited sufficient strength for high temperature applications, such as large cast IGT blades and vanes, as evidenced by the results in Tables II and III. Alloy stability (e.g. absence of sigma formation) is maintained by keeping the Cr content at a reduced level, such as in the range of 13–14 weight %, preferably 13.5 weight %, to compensate for the lower carbon content.

The results of machining testing are set forth in TABLE IV below where MACHINING TIME in minutes indicates the time to complete machining of the specimen and PERCENT CHANGE indicates increase or decrease in machining time. Machining tests were conducted at a production gas turbine blade machining facility. The fir tree area of the roots of test rotating blades cast pursuant to the invention were machined using creep feed grinding (i.e. grinding with a pre-contoured diamond roll at controlled feed rates relative to the workpiece). During grinding, the machined root fir tree area was cooled with a cooling fluid to avoid grinding cracks.

The results of the machining tests of castings made pursuant to the invention were compared to current commercially manufactured cast alloy blades made from Rene 80 nickel base superalloy, which are very susceptible to grinding cracks due to the cast/heat treated microstructure, especially the formation of large primary carbide particles in the heavy cross-section of the blade root. This microstructural condition of these commercially manufactured blades requires very smooth grinding with a low grinding depth per pass (e.g. 0.25 mm per pass).

As a result, current Rene 80 cast and heat treated large IGT 4th stage blades machined using such smooth grinding parameters required a minimum time of 270 minutes to machine the fir tree of the blade root as set forth in Table IV. Machining trials with similar IGT 4th stage blades cast from the alloy pursuant to the invention and heat treated as described above were conducted on the same production grinding machines using increased feed rates (e.g. 0.4 mm per pass).

TABLE IV

| ALLOY | MACHINING TIME (Typical Large Blade) | PERCENT CHANGE Increase (Decrease) |
|---|---|---|
| Baseline (U.S. Pat. No. 3,615,376) | 270 minutes minimum | — |
| Invention | 180 minutes maximum | (33%) |

It is apparent that specimens produced from heat #1 exhibited a minimum machining time of 270 minutes to complete machining of the root fir tree area. In contrast, the specimens produced from heat #2 pursuant to the invention exhibited a maximum machining time of 180 minutes to complete machining of the root fir tree area. The decrease in machining time of the specimens of heat #2 pursuant to the invention equates to a 33% reduction in required machining time as compared to that for the specimens of the BASELINE superalloy with higher carbon content and thus a direct reduction in machining costs.

The above test data represent an unexpected and surprising improvement in machinability of the carbon modified superalloy pursuant to the invention as compared to that of BASELINE superalloy, while achieving comparable high temperature tensile and stress rupture properties.

The present invention is effective to provide large cross-section, equiaxed grain castings with substantially improved machinability. The present invention is especially useful to produce large equiaxed grain IGT blade and vane castings which have the alloy composition described above to impart substantially improved machinability to such castings after appropriate heat treatment. Such IGT castings typically have a length of about 20 centimeters to about 80 centimeters and above, such as about 110 centimeters length, and are used throughout the stages of the turbine of stationary industrial gas turbine engines. The above described carbon modified nickel base superalloy casting composition is useful cast as DS columnar grain components.

While the invention has been described in terms of specific embodiments thereof, it is not intended to be limited thereto but rather only to the extent set forth in the following claims.

What is claimed is:

1. A machineable nickel base superalloy casting consisting essentially of, in weight %, about 12.5 to about 15% Cr, greater than about 5% to less than about 15% Co, about 2.5% to about 5% Mo, about 3% to about 6% W, about 2% to about 4% Al, about 4% to about 6% Ti, about 0.005% to about 0.02% B, up to about 0.1% Zr, about 0.055% to about 0.075% carbon, and balance essentially nickel.

2. A machineable nickel base alloy casting, consisting essentially of, in weight %, about 12.5% to 15% Cr, about 9.00% to 10.00% Co, about 3.70% to 4.30% Mo, about 3.70% to 4.30% W, about 2.80% to 3.20% Al, about 4.80% to 5.20% Ti, about 0.005% to 0.02% B, up to about 0.10% Zr, and balance essentially Ni and carbon below about 0.08 weight % to improve machinability.

3. The casting of claim 2 wherein C is about 0.055% to about 0.075% by weight of said superalloy.

4. The casting of claim 2 wherein C is nominally 0.07 weight %.

5. The casting of claim 1 which is gas turbine engine blade or vane having a length of about 20 centimeters to about 110 centimeters.

6. A heat treated equiaxed grain nickel base alloy casting having a composition consisting essentially of, in weight %, about 12.5% to 15% Cr, about 9.00% to 10.00% Co, about 3.70% to 4.30% Mo, about 3.70% to 4.30% W, about 2.80% to 3.20% Al, about 4.80% to 5.20% Ti, about 0.01% to 0.02% B, about 0.005% to 0.10% Zr, about 0.055% to about 0.075% C, and balance essentially Ni where the carbon range improves machinability of the casting after heat treatment.

7. An equiaxed grain nickel base alloy casting consisting essentially of, in weight %, nominally about 13.50% Cr, about 9.40% Co, about 4.00% Mo, about 4.00% W, about 3.00% Al, about 5.00% Ti, about 0.015% B, about 0.07% C, and balance essentially Ni where the carbon content is effective to improve machinability.

8. A method of making a nickel base superalloy casting, comprising providing a nickel base superalloy consisting essentially of, in weight %, about 12.5 to about 15% Cr, greater than about 5% to less than about 15% Co, about 2.5% to about 5% Mo, about 3% to about 6% W, about 2% to about 4% Al, about 4% to about 6% Ti, about 0.005% to about 0.02% B, up to about 0.1% Zr, below about 0.08% C, and balance essentially nickel, melting said superalloy to form a melt, casting said melt in a mold to form an equiaxed grain casting, heat treating said casting, and machining the heat treated casting wherein the carbon concentration of said superalloy below about 0.08 weight % improves machinability.

9. A method of improving the machinability of a nickel base superalloy consisting essentially of, in weight %, about 12.5% to 15% Cr, about 9.00% to 10.00% Co, about 3.70% to 4.30% Mo, about 3.70% to 4.30% W, about 2.80% to 3.20% Al, about 4.80% to 5.20% Ti, about 0.005% to 0.02% B, up to about 0.10% Zr, and balance essentially Ni and carbon, including maintaining the carbon concentration of said superalloy below about 0.08 weight % C.

10. The method of claim 9 wherein C is maintained within the range of about 0.055% to about 0.075% by weight C.

11. Nickel base superalloy consisting essentially of, in weight %, about 12.5 to about 15% Cr, greater than about 5% to less than about 15% Co, about 2.5% to about 5% Mo, about 3% to about 6% W, about 2% to about 4% Al, about 4% to about 6% Ti, about 0.005% to about 0.02% B, up to about 0.1% Zr, about 0.055% to about 0.075% carbon, and balance essentially nickel wherein the carbon concentration range of about 0.055% to about 0.075% C improves machinability of a casting made from said superalloy.

12. Nickel base alloy consisting essentially of, in weight %, of about 12.5% to 15% Cr, about 9.00% to 10.00% Co, about 3.70% to 4.30% Mo, about 3.70% to 4.30% W, about 2.80% to 3.20% Al, about 4.80% to 5.20% Ti, about 0.005% to 0.02% B, up to about 0.10% Zr, and balance essentially Ni and carbon below about 0.08 weight % to improve machinability.

13. The alloy of claim 12 wherein C is about 0.055% to about 0.075% by weight C.

14. A nickel base superalloy industrial gas turbine engine blade or vane casting having an equiaxed grain microstructure, consisting essentially of, in weight %, about 12.5 to about 15% Cr, greater than about 5% to less than about 15% Co, about 2.5% to about 5% Mo, about 3% to about 6% W, about 2% to about 4% Al, about 4% to about 6% Ti, about 0.005% to about 0.02% B, up to about 0.1% Zr, below about 0.8% C, and balance essentially nickel wherein the carbon concentration below about 0.08 weight % improves machinability of said casting.

15. The casting of claim 14 having a length of about 20 centimeters to about 110 centimeters.

16. A method of making an industrial gas turbine engine blade or vane casting, comprising providing a nickel base superalloy consisting essentially of, in weight %, about 12.5 to about 15% Cr, greater than about 5% to less than about 15% Co, about 2.5% to about 5% Mo, about 3% to about 6% W, about 2% to about 4% Al, about 4% to about 6% Ti, about 0.005% to about 0.02% B, up to about 0.1% Zr, below about 0.08% C, and balance essentially nickel, melting said superalloy to form a melt, casting said melt in a mold to form said casting having an equiaxed grain microstructure, heat treating said casting, and machining the heat treated casting wherein the carbon concentration below about 0.08 weight % improves machinability.

* * * * *

UNITED STATES PATENT AND TRADEMARK OFFICE

CERTIFICATE OF CORRECTION

PATENT NO. : 6,231,692 B1
DATED : May 15, 2001
INVENTOR(S) : Russell G. Vogt et al.

It is certified that error appears in the above-identified patent and that said Letters Patent is hereby corrected as shown below:

Title page,
In the title please delete "AND METHOD OF MAKING THEREOF".

Signed and Sealed this

Twenty-fifth Day of December, 2001

*Attest:*

*Attesting Officer*

JAMES E. ROGAN
*Director of the United States Patent and Trademark Office*